United States Patent [19]

Kawashima

[11] 3,956,800

[45] May 18, 1976

[54] AUTOMATICALLY LOCKING SLIDER FOR SLIDE FASTENERS

[75] Inventor: Teruaki Kawashima, Namerikawa, Japan

[73] Assignee: Yoshida Kogyo Kabushiki Kaisha, Japan

[22] Filed: Jan. 30, 1975

[21] Appl. No.: 545,580

[30] Foreign Application Priority Data

Feb. 7, 1974 Japan ..... 49-15865

[52] U.S. Cl. ..... 24/205.14 R

[51] Int. Cl.[2] ..... A44B 19/30

[58] Field of Search ..... 24/205.14 R

[56] References Cited

UNITED STATES PATENTS

| | | | |
|---|---|---|---|
| 2,622,296 | 12/1952 | Erdmann | 24/205.14 R |
| 2,810,945 | 10/1957 | Legat | 24/205.14 R |
| 3,016,592 | 1/1962 | Manning | 24/205.14 R |
| 3,287,780 | 11/1966 | Cooperberg | 24/205.14 R |

FOREIGN PATENTS OR APPLICATIONS

| | | | |
|---|---|---|---|
| 658,385 | 2/1963 | Canada | 24/205.14 R |
| 705,078 | 3/1965 | Canada | 24/205.14 R |

*Primary Examiner*—Bernard A. Gelak
*Attorney, Agent, or Firm*—Bucknam and Archer

[57] ABSTRACT

An automatic slider lock mechanism including a locking leaf spring arranged longitudinally over the slider body and having a locking pawl at its rear end which normally projects into the usual Y-shaped guide channel in the slider body for interference contact with rows of interlocking fastener elements passing therethrough. The locking leaf spring includes a neck portion directly overlying the top wing of the slider body and having a fold at its front end arranged in parallel spaced relationship thereto. The fold has a pair of arms extending downwardly therefrom into abutting contact with the top wing, and a pair of flanges project laterally outwardly from parts of the bottom edges of the respective arms to be engaged by respective spring retainers on the top wing. The locking pawl retracts away from the guide channel when a pull is exerted on the pull tab of the slider.

1 Claim, 5 Drawing Figures

AUTOMATICALLY LOCKING SLIDER FOR SLIDE FASTENERS

BACKGROUND OF THE INVENTION

This invention relates generally to slide fasteners and in particular to an automatically locking slider for slide fasteners. Still more specifically, the invention is directed to an automatic slider lock mechanism of the type including a leaf spring overlying the slider body and having a locking pawl at one end which normally projects into the Y-shaped guide channel in the slider body to lock the slider against movement on a pair of fastener stringers and which retracts away therefrom to unlock the slider when a pull is exerted on the pull tab of the slider.

In the known automatic slider lock mechanism of the above described type, the locking leaf spring arranged longitudinally over the top wing of the slider body is usually provided with a curved portion at its front end, which portion is the principal part lending the desired resiliency to the spring, and with a locking pawl at its rear end which normally projects into the slider body for interference contact with the rows of interlocking fastener elements passing therethrough. The pull tab of the slider is pivotally connected to the locking leaf spring at a point intermediate both ends thereof, in such a manner that the locking pawl retracts from within the slider body upon exertion of a pull on the pull tab.

The automatic slider lock mechanism of this prior art configuration manifests a serious deficiency when, for instance, a garment or like article to which there has been attached the slide fastener incorporating the slider in question is subjected to ironing operation. The pressure exerted upon the slider from above is easy to permanently strain the curved portion of the locking leaf spring, thereby causing a change in its spring constant and hence seriously impairing the performance of the lock mechanism.

In an attempt to overcome this deficiency, it has been proposed to provide a projection or projections upon the top wing of the slider body for protection of the curved portion of the locking leaf spring from pressures applied from above the slider. The slider body having such protection means, however, is usually produced by die casting, and die-cast sliders are of course significantly more expensive than those produced by pressing operation.

SUMMARY OF THE INVENTION

It is, therefore, among the objects of this invention to provide an improved automatic lock mechanism for the sliders of slide fasteners which includes a locking leaf spring so configured and arranged on the slider body as not to be strained by application of external forces.

Another object of the invention is to provide an automatically locking slider which is simple and endurable in construction, positive in operation, and manufacturable inexpensively by pressing operation only.

With these and other objects in view, this invention provides, in a slide fastener slider of the well known type, an automatic lock mechanism including a locking leaf spring generally arranged longitudinally over the slider body. The locking leaf spring includes a neck portion overlying the top wing of the slider body and having a fold arranged in parallel spaced relationship thereto. The neck portion is connected to the fold via at least one curved connective portion located at one end of the locking leaf spring which end is arranged at the front end of the slider body. The fold has a pair of arms extending downwardly from both lateral edges thereof into abutting contact with the top wing of the slider body, and a pair of flanges project laterally outwardly from parts of the bottom edges of the respective arms to be engaged by respective spring retainers on the top wing. The locking leaf spring further includes a locking pawl at the other end which normally projects into the slider body to engage the rows of interlocking fastener elements along which the slider is intended to move to open or close the fastener. The pull tab of the slider surrounds at one end the locking leaf spring in such a manner that the locking pawl retracts from within the slider body only when a pull is being exerted on the pull tab.

The features which are believed to be novel and characteristic of this invention are set forth in particular in the claims appended hereto. The invention itself, however, both as to its construction and mode of operation, together with the further objects and advantages thereof, will become apparent in the course of the following description of a preferred embodiment, which is to be read in connection with the accompanying drawings in which like reference characters refer to like parts throughout the several views.

DESCRIPTION OF THE PREFERRED EMBODIMENT

Figure 1:
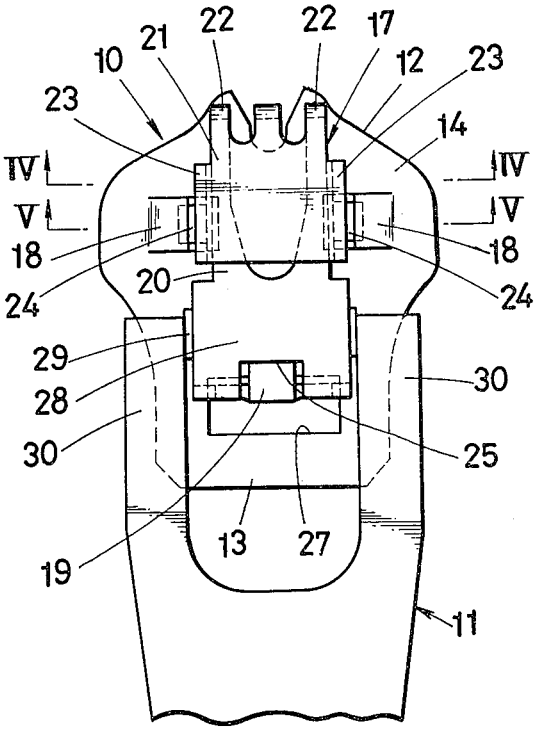
FIG. 1 is a top plan view of an automatically locking slider for slide fasteners constructed in accordance with the novel concepts of this invention, in which the pull tab is shown fragmentarily to facilitate the illustration.
Figure 2:
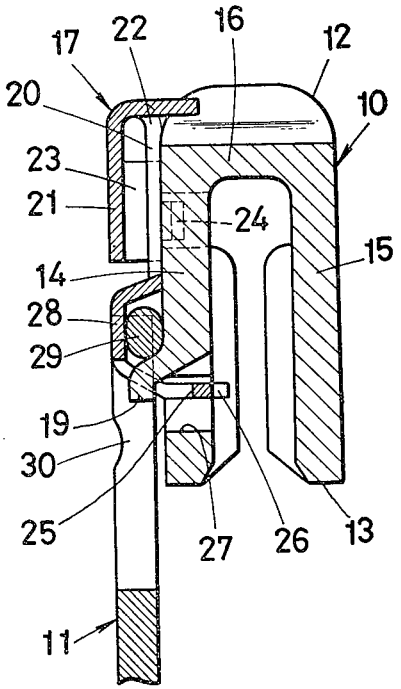
FIG. 2 is a sectional view taken along the longitudinal axis of the automatically locking slider shown in FIG. 1.

As will be seen from FIGS. 1 and 2, the slider for use with the automatic lock mechanism according to the invention can be of the well known type comprising a body 10 and a pull tab 11. The slider body 10 has a flared front end 12 and a contracted rear end 13 and is composed of a top wing 14 and a bottom wing 15 which are interconnected by a web or neck 16 located centrally at the flared front end 12. The usual Y-shaped guide channel is thus formed through the slider body 10 to permit rows of interlocking fastener elements, not shown, to pass therethrough as the slider is moved along the fastener elements to open or close the slide fastener.

The automatic lock mechanism according to the invention, shown in its preferred form in FIGS. 1 and 2, includes a locking leaf spring 17 generally arranged longitudinally over the top wing 14 of the slider body 10. Projecting upwardly from the top wing 14 of the slider body 10 are a pair of transversely spaced spring retainers 18, which are located rather closer to the flared front end 12 of the slider body than to its contracted rear end 13, and a stop 19 which is located centrally adjacent the contracted rear end of the slider body.

Figure 3:
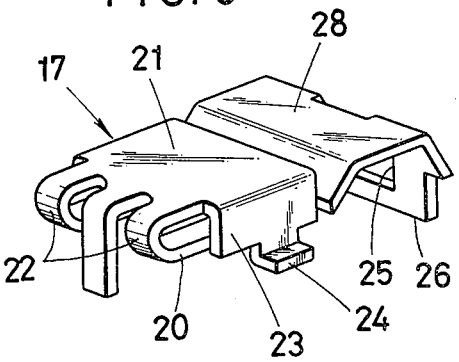
FIG. 3 is a perspective view of a locking leaf spring used in the automatically locking slider shown in FIGS. 1 and 2.

As will be seen also from FIG. 3, the locking leaf spring 17 includes a neck portion 20 which is arranged between the spring retainers 18. The neck portion 20 is connected to a fold 21 via one or more curved connective portions 22 located at the front end of the locking leaf spring 17. The fold 21 is arranged in parallel spaced relationship to the neck portion 20.

Figure 4:
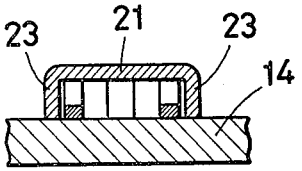
FIG. 4 is a sectional view taken along the plane of line IV—IV in FIG. 1.
Figure 5:
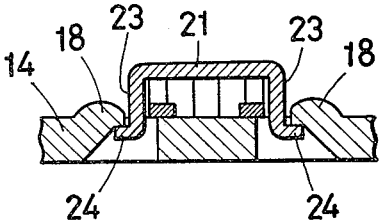
FIG. 5 is also a sectional view taken along the plane of line V—V in FIG. 1.

As best shown in FIGS. 3 and 4, the fold 21 of the locking leaf spring 17 has a pair of arms 23 extending downwardly from both lateral edges thereof into abutting contact with the top wing 14 of the slider body 10. Each arm 23 has a flange 24 projecting laterally outwardly from part of its bottom edge. It will be observed from a consideration of FIG. 5 that the flanges 24 are rigidly held under the respective spring retainers 18 on the top wing 14 of the slider body 10, in such a fashion that the major portion of the locking leaf spring 17 is resiliently urged against the slider body.

Referring again to FIGS. 1 and 2 in particular, the locking leaf spring 17 has an aperture 25 adjacent its rear end which is adapted to relatively loosely receive the stop 19 projecting upwardly from the top wing 14 of the slider body 10 adjacent the contracted rear end thereof. At its rear end the locking leaf spring 17 terminates in a locking pawl 26 which normally projects into the guide channel of the slider body 10 via an aperture 27 formed in its top wing 14.

The locking leaf spring 17 has a raised portion 28 between its neck portion 20 and locking pawl 26. There is arranged between this raised portion 28 of the locking leaf spring 17 and the top wing 14 of the slider body 10 a relatively flat pin 29 extending between the tips of a pair of prongs 30 at the bifurcated end of the pull tab 11. When viewed vertical-sectionally as in FIG. 2, the pin 29 is elongated in the general plane of the pull tab 11.

Thus, when a pull is exerted on the pull tab 11 surrounding the locking leaf spring 17 at one end thereof to move the slider along the unshown rows of fastener elements in either direction, the pin 29 of the pull tab becomes held at a certain angle to the plane of the top wing 14 of the slider body 10. With the raised portion 28 of the locking leaf spring 17 thus lifted away from the top wing 14, a tip of the locking pawl 26 at its rear end moves out of interference contact with the fastener elements as it retracts into the aperture 27 in the top wing. The retracting motion of the locking pawl 26 is limited by the stop 19 received in the aperture 25 of the locking leaf spring 17. The slider, now unlocked, is free to move along the rows of fastener elements as long as there is a pull on the pull tab 11. When the pull tab is released, the locking pawl 26 again projects into the guide channel of the slider body 10 to engage the fastener elements and hence to lock the slider in the desired position on the pair of fastener stringers.

It will be appreciated that even when high pressure is exerted on the locking leaf spring 17 from above the slider body 10, as in the ironing operation of the article to which the slider fastener is attached, the curved portion or portions 22 of the locking leaf spring will not be easily deformed or otherwise damaged. This is due to the provision of the arms 23 extending downwardly from both lateral edges of the fold 21 into abutting contact with the top wing 14 of the slider body 10. Furthermore, since the arms 23 have the flanges 24 that are securely engaged by the respective spring retainers 18 on the top wing 14, the locking leaf spring 17 can be mounted on the slider body 10 practically against any possibility of displacement.

The slider equipped with the automatic lock mechanism according to the invention will therefore function efficiently for an extended length of time in spite of the possible severe working conditions to which it may be subjected in the use of the complete slide fastener.

Having thus described the automatically locking slider for slide fasteners according to the invention, it is clear that the objects as above stated, either explicitly or otherwise, have been accomplished in a simple and practical manner. However, while the invention has been shown and described herein in terms of but one of its various possible adaptations, it is to be understood that changes may be made in the construction and arrangement of the various parts of the illustrated slider, without necessarily departing from the spirit and scope of the invention as sought to be defined in the following claims.

What is claimed is:

1. In a slide fastener slider of the type having a pull tab and a body and a locking means, said slider body including a top wing and a bottom wing which are interconnected by a web located centrally at the front end of said slider body to define a generally Y-shaped guide channel therethrough, an automatic lock mechanism comprising, in combination, a locking leaf spring generally arranged longitudinally over said top wing of said slider body and including a neck portion directly overlying said top wing, said neck portion being connected to a fold via at least one curved portion at one end of said locking leaf spring which end is arranged at said front end of said slider body, said fold being held in parallel spaced relationship to said neck portion, a pair of arms extending downwardly from both lateral edges of said fold into abutting contact with said top wing, a pair of flanges projecting laterally outwardly from parts of the bottom edges of said arms respectively, a pair of spring retainers on the top wing adapted to engage said respective flanges of said arms and hence to retain said locking leaf spring on said slider body, a locking pawl at the other end of said locking leaf spring which normally projects into said guide channel in said slider body through an aperture formed in said top wing, and a raised portion between said neck portion and integrally connected to said locking pawl of said locking leaf spring, which raised portion is linked by said pull tab in such a manner that when a pull is exerted on said pull tab, said locking leaf spring is generally raised away from said slider body whereby said locking pawl retracts away from said guide channel in said slider body, said fold having a terminal edge located forwardly of said raised portion to expose same for free movement with said locking pawl by the pull tab; and stop means operable to limit the retracting motion of said locking pawl away from said guide channel, said stop means including a stop projecting upwardly from said top wing of the slider body and received through an aperture formed in said locking leaf spring.

* * * * *